US007479095B2

(12) United States Patent
Wang

(10) Patent No.: US 7,479,095 B2
(45) Date of Patent: Jan. 20, 2009

(54) INTERACTIVE EXERCISER

(76) Inventor: Leao Wang, No. 1, Lane 233, Sec. 2, Charng Long Rd., Taiping (TW) 411

( * ) Notice: Subject to any disclaimer, the term of this patent is extended or adjusted under 35 U.S.C. 154(b) by 0 days.

(21) Appl. No.: 11/799,483

(22) Filed: May 2, 2007

(65) Prior Publication Data

US 2008/0274862 A1 Nov. 6, 2008

(51) Int. Cl.
*A63B 69/24* (2006.01)

(52) U.S. Cl. ..... 482/87

(58) Field of Classification Search ..... 482/148, 482/87

See application file for complete search history.

(56) References Cited

U.S. PATENT DOCUMENTS 5,803,877 A * 9/1998 Franey ..... 482/83
6,110,079 A * 8/2000 Luedke et al. ..... 482/83
2007/0184952 A1* 8/2007 Matsubara et al. ..... 482/142

* cited by examiner

*Primary Examiner*—Lori Amerson

(57) ABSTRACT

An interactive exerciser including an upper and a lower servomotor both of which are vertically assembled to be an interacting mechanism. The upper servomotor is disposed on a support at the top of a turning shaft of the lower servomotor such that the upper servomotor can be actuated by the lower servomotor to produce a rotation in horizontal direction. Besides, the upper servomotor is perpendicular to the lower servomotor. A rocking bar is vertically disposed on a turning shaft. A target portion with sensors is mounted on the top of the rocking bar. A positioning socket is interposed between the support and the rocking bar for restricting the swinging range of the rocking bar. Accordingly, the sensors are employed to detect the position, movement direction and speed of the external objects (or the operators). Thereafter, a control unit is used to give out a command to control the rotating and swinging action of the upper and the lower servomotor. In this way, the target portion can effectively avoid the approach of external objects.

2 Claims, 3 Drawing Sheets

INTERACTIVE EXERCISER

BACKGROUND OF THE INVENTION

1. Fields of the Invention

The invention relates to an interactive exerciser, and more particularly, to an interactive exerciser in which two vertically coupled servomotors and several sensors are employed. Meanwhile, a control unit includes a built-in program that gives out a predetermined command for achieving a rapid drive of target.

2. Description of the Related Art

It is well-known that a fixed type target is provided for users to make boxing games or exercise. The target must be brought in a swing state when subject to the external force. Accordingly, the user can decide the timing and position of the next boxing action depending on the swing speed and position of the target, thereby achieving a certain training effect. In view of the basic defense in the boxing exercise, both parties will make their timely dodging defense reaction according to the fist-striking position and time of the opponent. As a result, to command the attacking time is not so easy as to strike the target.

In brief, the conventional target will become uninteresting for the user in a short time. The reason lies in that the change of displacement is easily controlled by the user, thereby losing the patience of taking further challenges.

SUMMARY OF THE INVENTION

A primary object of the invention is to provide an interactive exerciser that employs the modern technique of the automatic detection and the automatic control to be in control of the position, the speed, and the movement path of the external objects. Meanwhile, the target can avoid the approach of the external objects due to the instant displacement order of a control unit. In this way, the enjoyment and the variety of the boxing exercise can be increased.

In order to achieve the above-mentioned object of the invention, an interactive exerciser includes an upper and a lower servomotor both of which are vertically assembled to be an interacting mechanism such that a turning and swinging action of the target disposed at the top of the upper servomotor can be achieved by the instructions of the built-in program which are given out by a control unit via sensors in detecting and sensing the external objects. In this way, the target can efficiently avoid the approach of the external objects.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
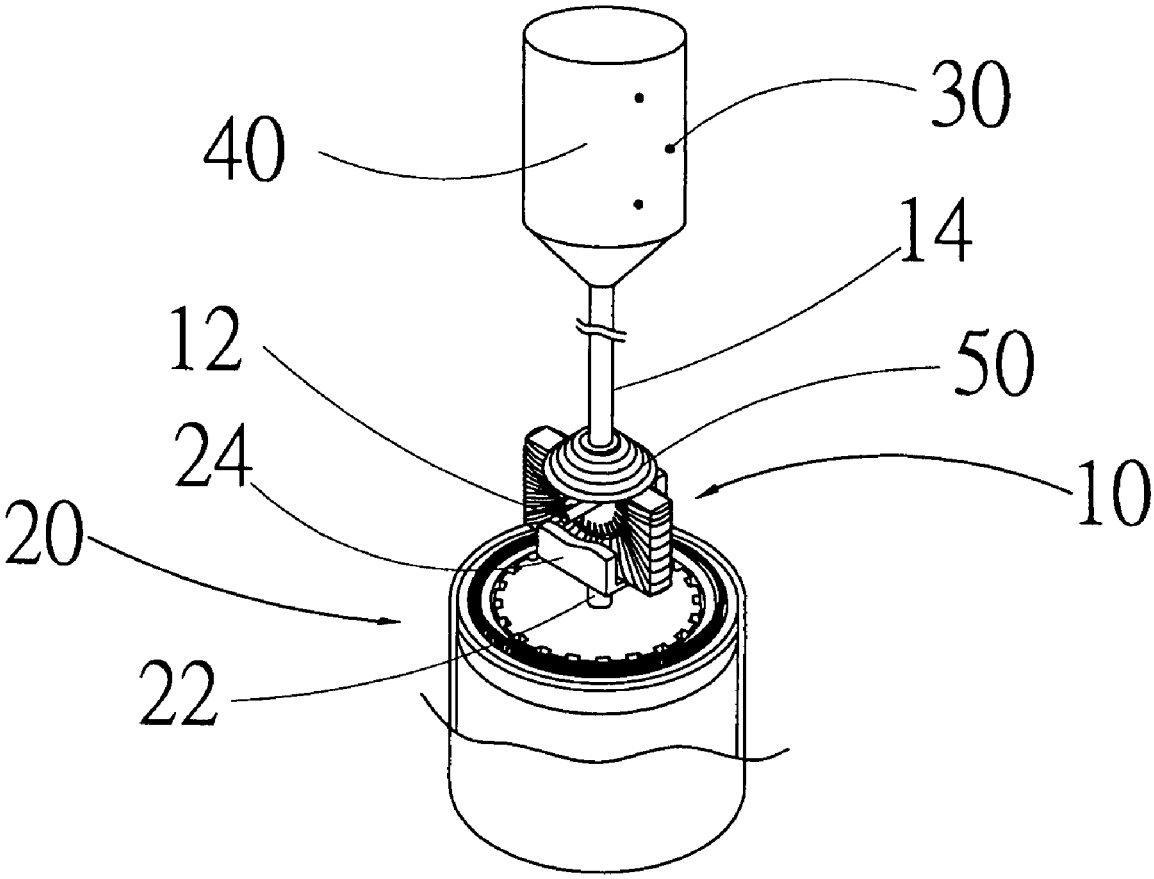
FIG. 1 is a perspective view of a preferred embodiment of the invention.
Figure 2:
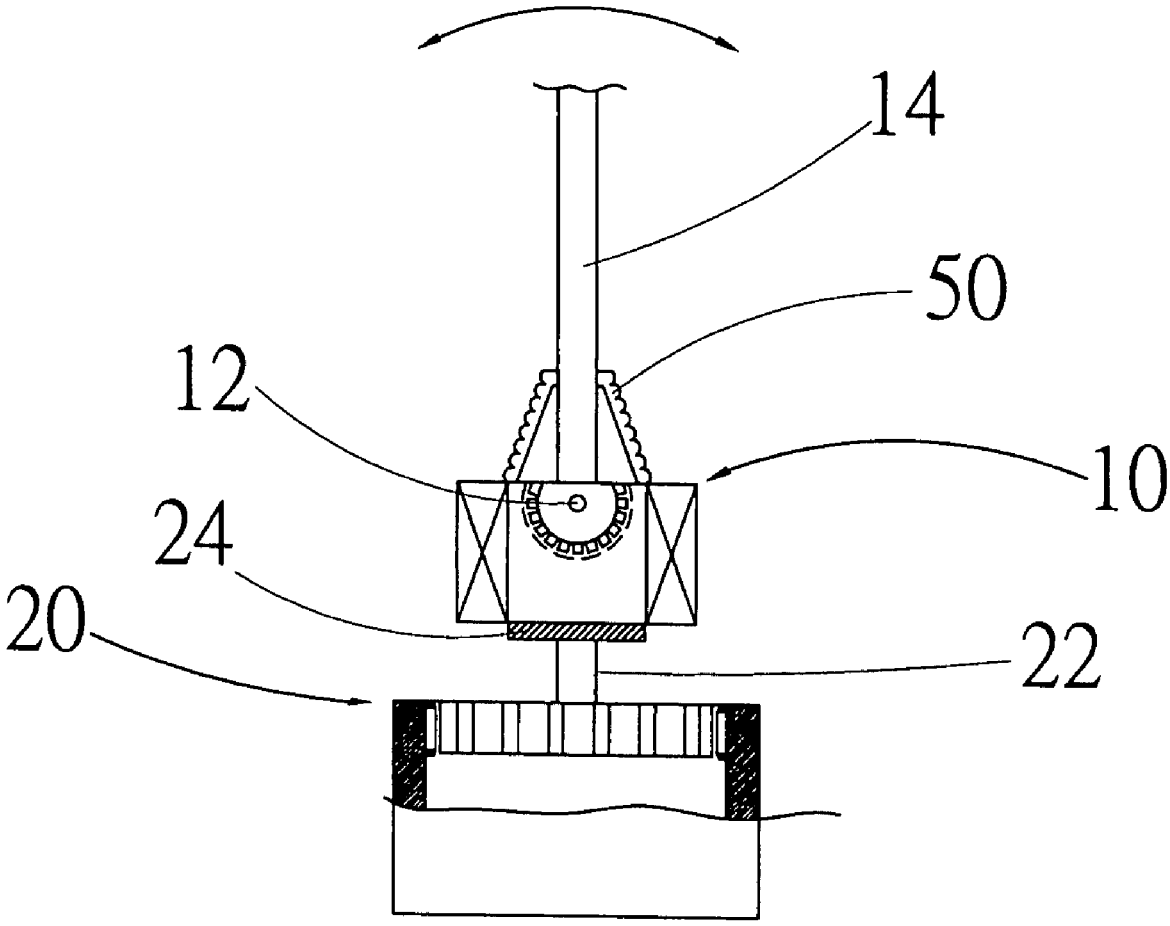
FIG. 2 is a front and partial cutaway view of the embodiment according to FIG. 1.
Figure 3:
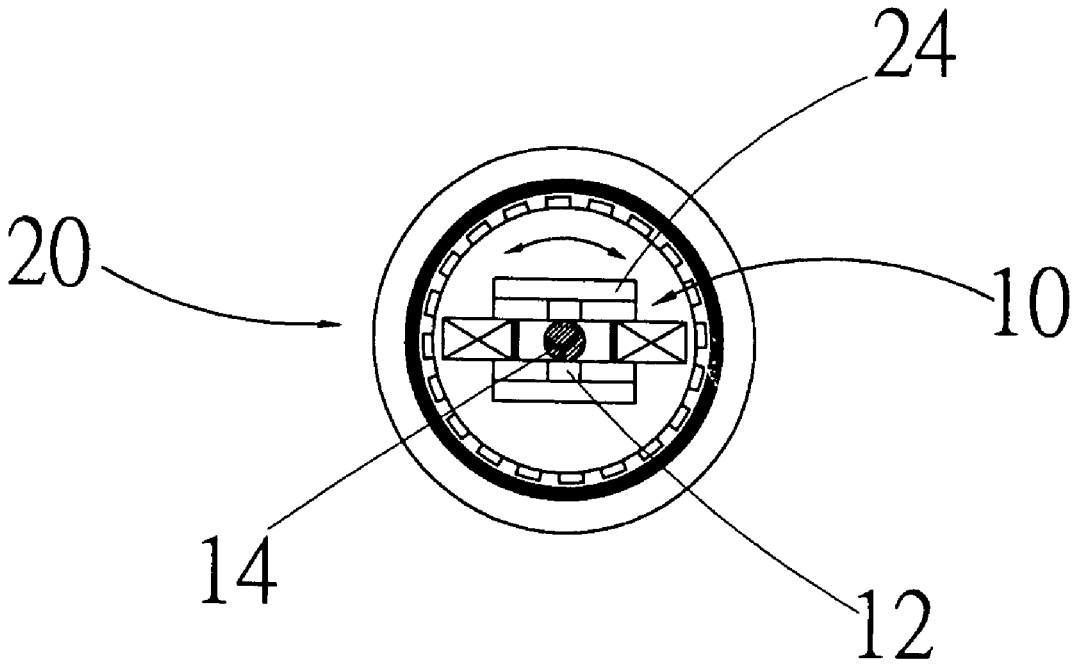
FIG. 3 is a top and partial cutaway view of the embodiment according to FIG. 1.

First, with reference to FIGS. 1 through 3, a preferred embodiment of the invention substantially includes an upper and a lower servomotor 10, 20 both of which are vertically assembled to be an interacting mechanism. The upper servomotor 10 is disposed on a support 24 at the top of a turning shaft 22 of the lower servomotor 20 such that the upper servomotor 10 can be actuated by the lower servomotor 20 to produce a rotation in horizontal direction. Besides, the upper servomotor 10 is perpendicular to the lower servomotor 20. A rocking bar 14 is vertically disposed on a turning shaft 12. A target portion 40 with sensors 30 is mounted on the top of the rocking bar 14. A positioning socket 50 is interposed between the support 24 and the rocking bar 14 for restricting the swinging range of the rocking bar 14.

Figure 4:
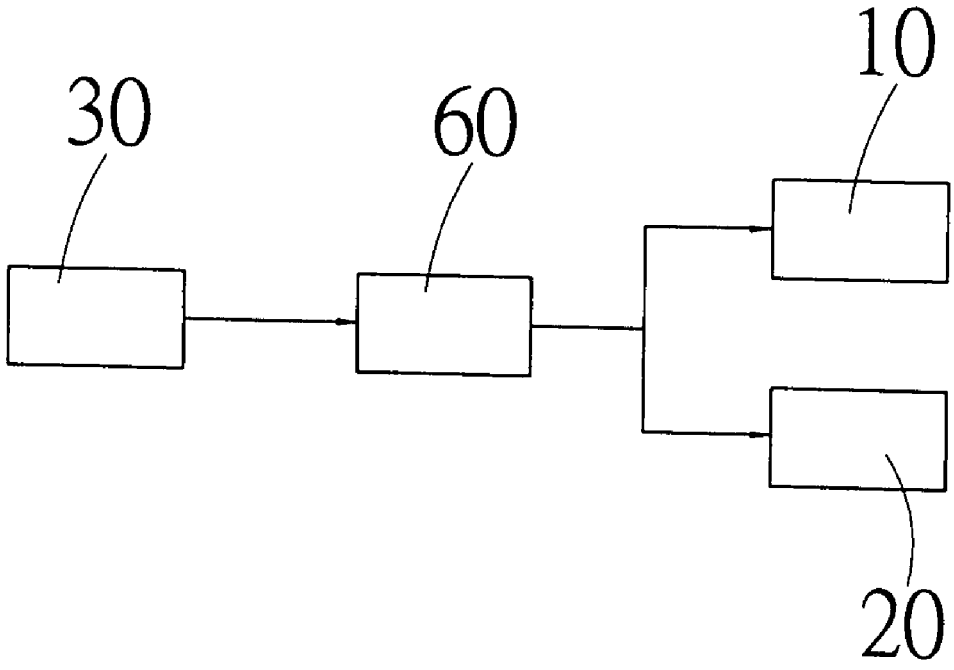
FIG. 4 is a flow chart of the operation and control of the invention.

As shown in FIG. 4, the sensors 30 in accordance with the invention are employed to detect the position, movement direction and speed of the external objects (not shown). Thereafter, a control unit 60 is used to give out a command to control the rotating and swinging action of the upper and the lower servomotor 10, 20. In this way, the target portion 40 can effectively avoid the approach of external objects.

It is well known that the motor includes a rotor and a stator both of which are operated in cooperation with a basic electromagnetic mechanism consisting of permanent magnets and induction coils. The turning shafts 12, 22 mean a rotating shaft at the rotor portion. This belongs to the area of the prior art and is not the object of the invention so that no further descriptions are given hereinafter.

The so-called servomotor includes an angle feedback unit (not shown) such that a continuous charging and discharging operation takes place according to the feedback signals when the motor is in a standstill state. In brief, the servomotor is in a standard electric state when the current is applied to drive the servomotor. In other words, the electric energy is converted into the kinetic energy. Meanwhile, an automatic conversion into the electromagnetic state takes place when no current is applied. In this way, the positioning and standstill effect is achieved (that is, the rotor can't be rotated more). When this configuration is applied to the invention, basic exercise modes of simulating the human actions like rapid reaction, displacement and in-place standstill are ensured for creating an interactive effect with the operator.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claim.

What is claimed is:

1. An interactive exerciser for use with external objects comprising:

a) a lower servomotor having:
   i) a lower turning shaft; and
   ii) a support located on a top of the lower turning shaft;

b) an upper servomotor located in the support of the lower servomotor and located in a position perpendicular to the lower servo motor, the lower servomotor providing a rotating motion and the upper servomotor providing a swinging motion, the upper servomotor having:
   i) an upper turning shaft;
   ii) a rocking bar located on a top of the upper turning shaft; and
   iii) a positioning socket interposed between the support and the rocking bar and restricting a swinging range of the rocking bar;

c) a target portion located on a top of the rocking bar and having sensors detecting a position, movement direction, and speed of the external objects; and d) a control unit communication with the sensors and controlling the rotating motion of the lower servomotor and the swinging motion of the upper servomotor, wherein the control unit and the sensors moving the target portion to avoid approaching external objects.

2. The according to claim 1, wherein the upper servomotor is actuated by the lower servo motor to product a rotation in a horizontal direction.

* * * * *